US011613938B2

(12) United States Patent
Bin Abdul Shukor et al.

(10) Patent No.: US 11,613,938 B2
(45) Date of Patent: Mar. 28, 2023

(54) DUAL CLUTCH SYSTEM FOR TRAVEL JOINT

(71) Applicant: Halliburton Energy Services, Inc., Houston, TX (US)

(72) Inventors: Muhammad Arra'uf Bin Abdul Shukor, Dhahran (SA); Xian Zhi Lim, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 40 days.

(21) Appl. No.: 17/188,746

(22) Filed: Mar. 1, 2021

(65) Prior Publication Data

US 2022/0275689 A1 Sep. 1, 2022

(51) Int. Cl.

| | |
|---|---|
| ***E21B 17/06*** | (2006.01) |
| ***E21B 17/05*** | (2006.01) |
| ***E21B 17/07*** | (2006.01) |

(52) U.S. Cl.

CPC ..... *E21B 17/06* (2013.01); *E21B 17/05* (2013.01); *E21B 17/07* (2013.01)

(58) Field of Classification Search

CPC ..... E21B 17/05; E21B 17/07

See application file for complete search history.

(56) References Cited

U.S. PATENT DOCUMENTS 4,561,799 A * 12/1985 Arena ..... B21D 26/14 403/375
7,178,611 B2 2/2007 Zupanick
7,497,254 B2 * 3/2009 Hall ..... E21B 47/01 166/242.6
8,177,157 B2 * 5/2012 Weissbrod ..... B65H 75/14 242/118.6
8,281,568 B2 * 10/2012 Danforth ..... C06B 45/00 102/288

(Continued)

FOREIGN PATENT DOCUMENTS

| | | |
|---|---|---|
| CA | 2935911 | 5/2019 |
| CN | 103370491 A | 10/2013 |

(Continued)

OTHER PUBLICATIONS

Halliburton,"Travel Joints", 2 pages.

(Continued)

*Primary Examiner* — Jonathan Malikasim
(74) *Attorney, Agent, or Firm* — Kilpatrick Townsend & Stockton LLP

(57) ABSTRACT

A dual clutch travel joint system includes an inner-mandrel and an outer-mandrel. The inner-mandrel includes a first connector on a downhole portion of the inner-mandrel and a second connector on an uphole portion of the inner-mandrel. The outer-mandrel includes a third connector that is positionable to mate with the first connector to apply torque to the inner-mandrel while the inner-mandrel is in a tension arrangement with the outer-mandrel within a wellbore. Additionally, the outer-mandrel includes a fourth connector positionable to mate with the second connector to apply torque to the inner-mandrel while the inner-mandrel is in a compression arrangement with the outer-mandrel within the wellbore.

16 Claims, 8 Drawing Sheets

(56) References Cited

U.S. PATENT DOCUMENTS

| | | | | |
|---|---|---|---|---|
| 8,443,895 | B2 * | 5/2013 | Harms | E21B 17/073 166/344 |
| 9,932,778 | B2 * | 4/2018 | Obrejanu | E21B 23/01 |
| 2004/0144571 | A1 | 7/2004 | Boyd | |
| 2013/0186690 | A1 | 7/2013 | Surjaatmadja et al. | |
| 2016/0160576 | A1 | 6/2016 | Obrejanu | |
| 2017/0037692 | A1 | 2/2017 | Eldho et al. | |
| 2019/0292863 | A1 * | 9/2019 | Hughes | E21B 23/004 |

FOREIGN PATENT DOCUMENTS

| | | |
|---|---|---|
| WO | 2017118858 | 7/2017 |
| WO | 2020112080 | 6/2020 |

OTHER PUBLICATIONS

Schlumberger, "Model C Expansion Joint" 2008, 1 page.
Schlumberger ,"Model D Expansion Joint", 2008, 1 page.
PCT App. No. PCT/US2021/020422, "International Search Report and Written Opinion", dated Nov. 24, 2021, 10 pages.

* cited by examiner

DUAL CLUTCH SYSTEM FOR TRAVEL JOINT

TECHNICAL FIELD

The present disclosure relates generally to devices for transferring torque between components. More specifically, but not by way of limitation, this disclosure relates to a dual clutch system for a travel joint within a wellbore.

BACKGROUND

Travel joints may be used along completion strings to accommodate tubing movement or length changes while maintaining a hydraulic seal between a conduit of the completion string and an annulus between the completion string and a wall of a wellbore. Upon activation of a travel joint from a run-in-hole state, an uphole portion of the completion string may be positioned for either free rotation with respect to a downhole portion of the completion string or torque transfer to the downhole portion without also enabling free rotation. If downhole pressure tests fail after a travel joint is activated, tubing maneuverability to disengage the completion string from a bottom hole assembly (BHA), such as by applying tension, compression, rotation, or a combination thereof, may become limited based on a type of the travel joint in use.

DETAILED DESCRIPTION

Certain aspects and features of the present disclosure relate to a dual clutch system for a travel joint. Travel joints may be used along completion strings to accommodate tubing movement or length changes while maintaining a hydraulic seal between a conduit of the completion string and an annulus between the completion string and a wall of a wellbore. The travel joints may also be used to perform completion string manipulation. For example, the completion string manipulation may be used to install downhole tools along the completion string or to position or reposition the completion string within the wellbore.

The dual clutch system may enable the travel joint, upon activation from a run-in-hole state, to perform completion string manipulations while the travel joint is in a compression arrangement, in a tension arrangement, or in a free-rotation arrangement. The compression arrangement may refer to when an uphole portion of the completion string is providing a downhole force on a downhole portion of the completion string. The tension arrangement may refer to when the uphole portion of the completion string is providing an uphole force on the uphole portion of the completion string. Further, the free-rotation arrangement may refer to when the uphole portion of the completion string is not under compression or tension and enables the uphole portion and the downhole portion of the completion string to rotate independently from one another. The free-rotation arrangement may also be referred to as a disengaged clutch arrangement.

The dual clutch system may be made with lugs and slots that are machined in radial profiles of tubular members of the travel joint. The tubular members of the travel joint may be referred to as an inner-mandrel and an outer-mandrel. A seal may be positioned between the inner-mandrel and the outer-mandrel to maintain a hydraulic seal between a conduit within the travel joint and an annulus between the travel joint and a wall of the wellbore.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
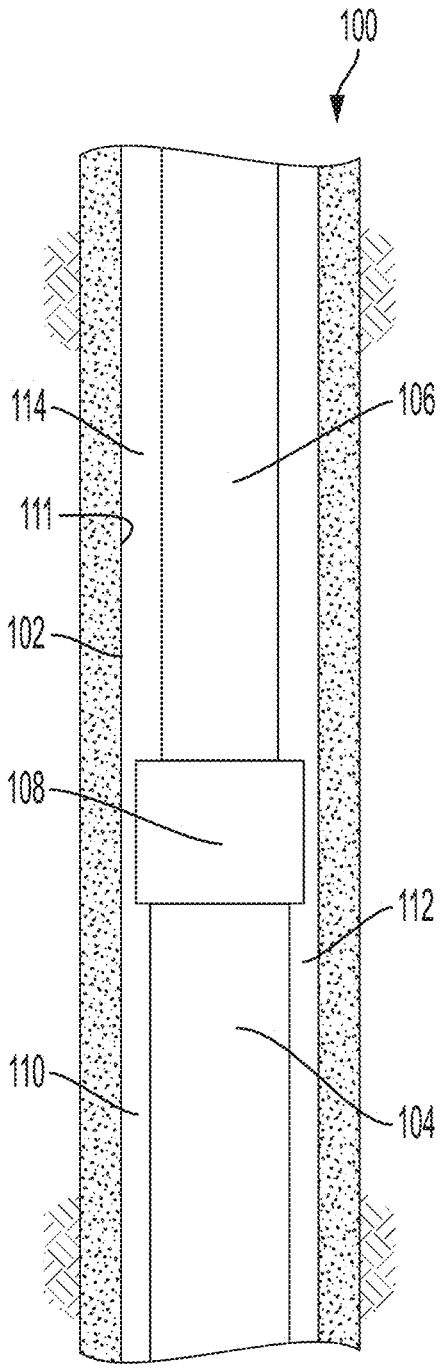
FIG. 1 is a cross-sectional view of one embodiment of a well system that can include a dual clutch system travel joint according to one embodiment of the present disclosure.

FIG. 1 is a cross-sectional view of one embodiment of a well system 100 according to one embodiment of the present disclosure. The well system 100 includes a wellbore 102. In some embodiments, the wellbore 102 can be cased and cemented, as shown in FIG. 1. In other embodiments, the wellbore 102 can be uncased or the casing may not be cemented.

The wellbore 102 can include a tubular string 104, for example, a downhole completion string. The tubular string 104 can be positioned in a downhole portion 112 of the wellbore 102 relative to a travel joint 108. Annulus 110 can be formed between the tubular string 104 and the wellbore 102.

The wellbore 102 can also include the travel joint 108, for example, a dual clutch system travel joint, as discussed in greater detail below with respect to FIG. 2. In some embodiments, the travel joint 108 can accommodate tubing movement or length changes of the tubular string 104 while maintaining a hydraulic seal between a conduit within the tubular string 104 and the annulus 110 between the tubular string 104 and a wall 111 of the wellbore 102. The travel joint 108 may also be used to perform tubular string manipulation of the tubular string 104, a tubular string 106, or a combination thereof.

The wellbore 102 can further include the tubular string 106, for example, an upper completion string. The tubular string 106 can be positioned in an upper portion 114 of the wellbore 102 with respect to the travel joint 108. The travel joint 108 may provide a mechanism to couple the tubular string 106 with the tubular string 104.

Figure 2:
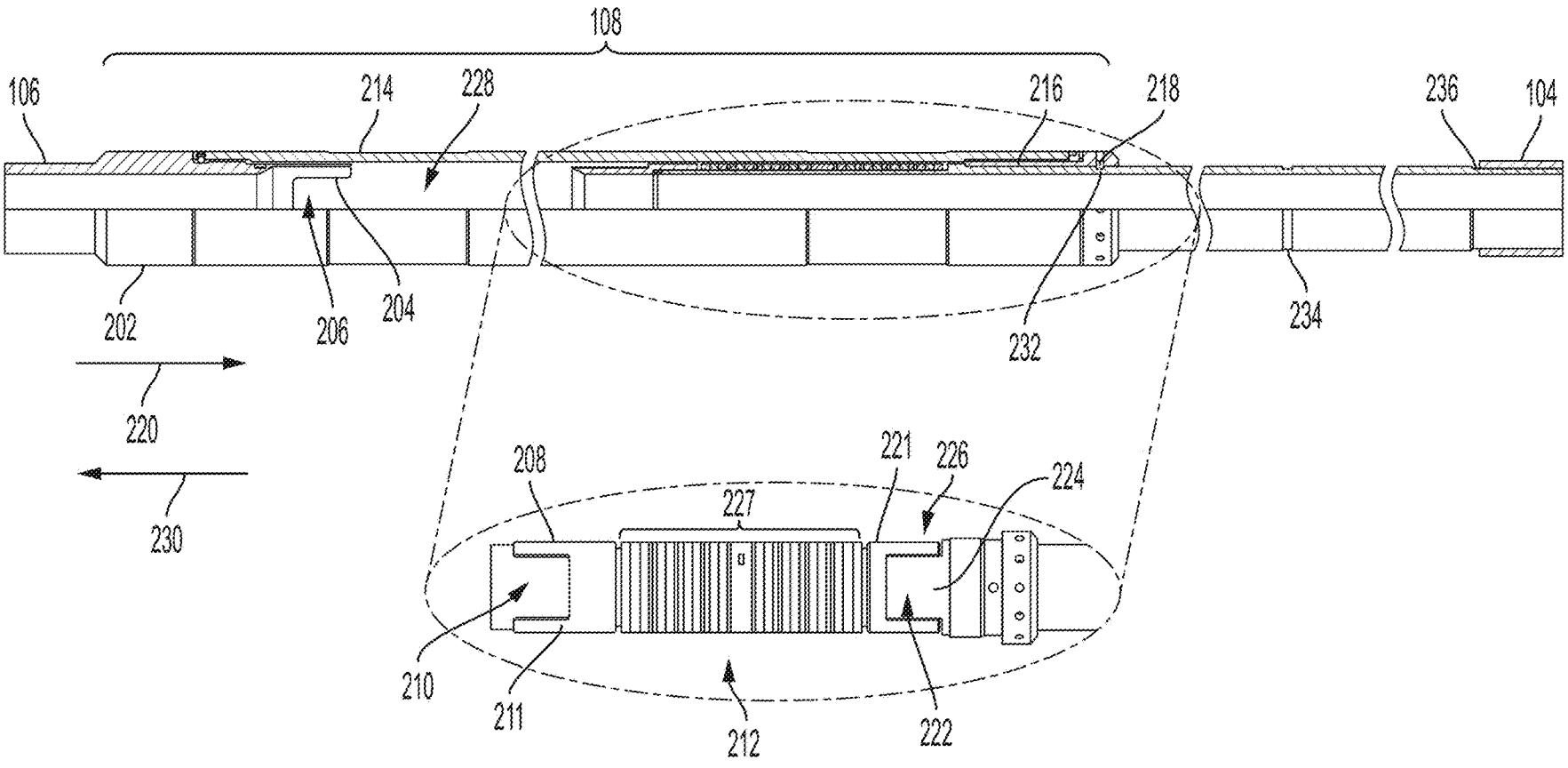
FIG. 2 is a sectional side view of the travel joint in FIG. 1 according to one embodiment of the present disclosure.

FIG. 2 is a sectional side view of the travel joint 108 according to one embodiment of the present disclosure. As illustrated, the travel joint 108 is positioned between the uphole tubular string 106 and the downhole tubular string 104. The uphole tubular string 106 may be attached to a top sub 202 of the travel joint 108. The top sub 202 may include lugs 204 and slots 206 that are positioned to mate with corresponding lugs 208 and slots 210 of an uphole portion 211 of an inner-mandrel 212 of the travel joint 108. The lugs and slots may be referred to as connectors, and the connectors may include other shapes that are keyed to mate with one another. The uphole portion 211 may be a separate piece of material from the remainder of the inner-mandrel 212. For example, the uphole portion 211 may affix to the inner-mandrel 212 using a threaded engagement or any other type of connection.

The top sub 202 may be coupled to an outer-mandrel 214 of the travel joint 108. The outer-mandrel 214 may encapsulate the inner-mandrel 212 and couple to a bottom sub 216 at a downhole end of the travel joint 108. The bottom sub 216 may include one or more shear pins 218 that maintain the travel joint 108 in an initial arrangement, such as a run-in-hole arrangement, until activation of the travel joint 108 is completed. Activation of the travel joint 108 may be accomplished by applying a compressive force in a direction 220 on the outer-mandrel 214 from the uphole tubular string 106. The compressive force may cause the shear pins 218 to shear. Upon shearing the shear pins 218, the travel joint 108 is able to move between a compression arrangement, a tension arrangement, and a free-rotation arrangement.

The inner-mandrel 212 may include lugs 221 and slots 222 that are positioned to mate with corresponding lugs 224 and slots 226 of the bottom sub 216. The lugs and slots may be referred to as connectors, and the connectors may include other shapes that are keyed to mate with one another. In some examples, and as illustrated, the inner-mandrel 212 may be mated with the bottom sub 216 in the run-in-hole arrangement prior to activation of the travel joint 108. When the inner-mandrel 212 is mated with the bottom sub 216, torque generated from rotation of the uphole tubular string 106 is transferred to the downhole tubular string 104 through the travel joint 108. Further, the inner-mandrel 212 may include a seal stack 227 that is able to maintain a seal between a conduit 228 of the travel joint 108 and the annulus 110, as depicted in FIG. 1.

After activation of the travel joint 108, the tension arrangement may involve the lugs 221 and the slots 222 of the inner-mandrel 212 mating with the lugs 224 and the slots 226 of the bottom sub 216. The tension arrangement may be generated by applying a force in an uphole direction 230 on the uphole tubular string 106. While in the tension arrangement, the torque generated from rotation of the uphole tubular string 106 is transferred to the downhole tubular string 104 through the travel joint 108.

The compression arrangement may involve the lugs 204 and the slots 206 of the top sub 202 mating with the lugs 208 and the slots 210 of the inner-mandrel 212. The compression arrangement may be generated after shearing of the shear pins 218 by applying a force in the downhole direction 220 on the uphole tubular string 106. While in the compression arrangement, the torque generated from rotation of the uphole tubular string 106 is transferred to the downhole tubular string 104 through the travel joint 108.

The free-rotation arrangement may involve disengagement of the connectors of the inner-mandrel with the connectors of the top sub 202 and the bottom sub 216. The free-rotation arrangement may be generated after shearing of the shear pins 218 by applying a force in the downhole direction 220 or in the uphole direction 230 on the uphole tubular string 106 to disengage the connectors. While in the free-rotation arrangement, the torque generated from rotation of the uphole tubular string 106 is not transferred to the downhole tubular string 104 through the travel joint 108. In other words, the outer-mandrel 214 and the inner-mandrel 212 are able to rotate independently from one another while in the free-rotation arrangement.

As illustrated, the shear pins 218 are installed within a groove 232 of the downhole tubular string 104. In this arrangement, the travel joint 108 is positionable within the wellbore 102 in the tension arrangement. In an example where the shear pins 218 are installed within a groove 234, the travel joint 108 may be positionable within the wellbore 102 in the free-rotation arrangement. In an additional example where the shear pins 218 are installed within a groove 236, the travel joint 108 may be positionable within the wellbore 102 in the compression arrangement. Upon activation of the travel joint 108 in any of these initial arrangements, the travel joint 108 is moveable between the tension arrangement, the free-rotation arrangement, and the compression arrangement depending on force applied to the uphole tubular string 106 in the downhole direction 220 or the uphole direction 230.

Figure 3:
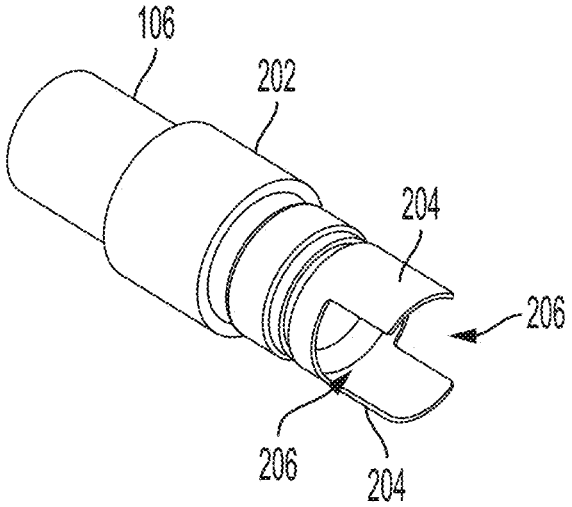
FIG. 3 is a perspective view of a top sub of the travel joint of FIG. 2 according to one embodiment of the present disclosure.

FIG. 3 is a perspective view of the top sub 202 of the travel joint 108 according to one embodiment of the present disclosure. The top sub 202 may be coupled to a downhole end of the uphole tubular string 106. The top sub 202 may include the lugs 204 and the slots 206 that are positioned to mate with the corresponding lugs 208 and slots 210 of the uphole portion 211 of the inner-mandrel 212 of the travel joint 108. While the top sub 202 is depicted with two lugs 204 and two slots 206, the top sub 202 may include any number of lugs and slots that are arranged or keyed to mate with a similar number of lugs and slots of the uphole portion 211 of the inner-mandrel 212.

Figure 4:
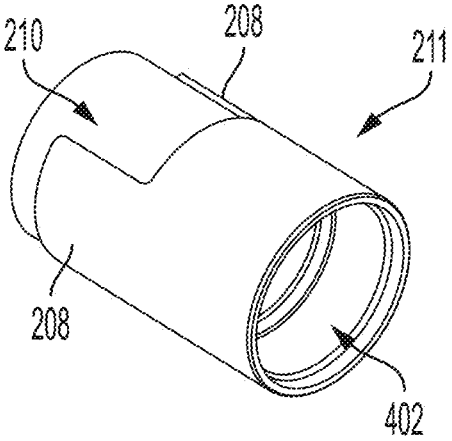
FIG. 4 is a perspective view of an uphole portion of an inner-mandrel of the travel joint of FIG. 2 according to one embodiment of the present disclosure.

FIG. 4 is a perspective view of the uphole portion 211 of the inner-mandrel 212 of the travel joint 108 according to one embodiment of the present disclosure. As discussed above with respect to FIG. 3, the uphole portion 211 includes the lugs 208 and the slots 210 that are arranged to mate with the corresponding lugs 204 and slots 206 of the top sub 202. The uphole portion 211 may mate with the top sub 202 when the travel joint 108 is in the compression arrangement.

The uphole portion 211 may be a separate piece of material from the remainder of the inner-mandrel 212. For example, the uphole portion 211 may include threads 402 that mate with threads on the inner-mandrel 212. Other non-threaded connections between the uphole portion 211 and the inner-mandrel 212 may also be used.

Figure 5:
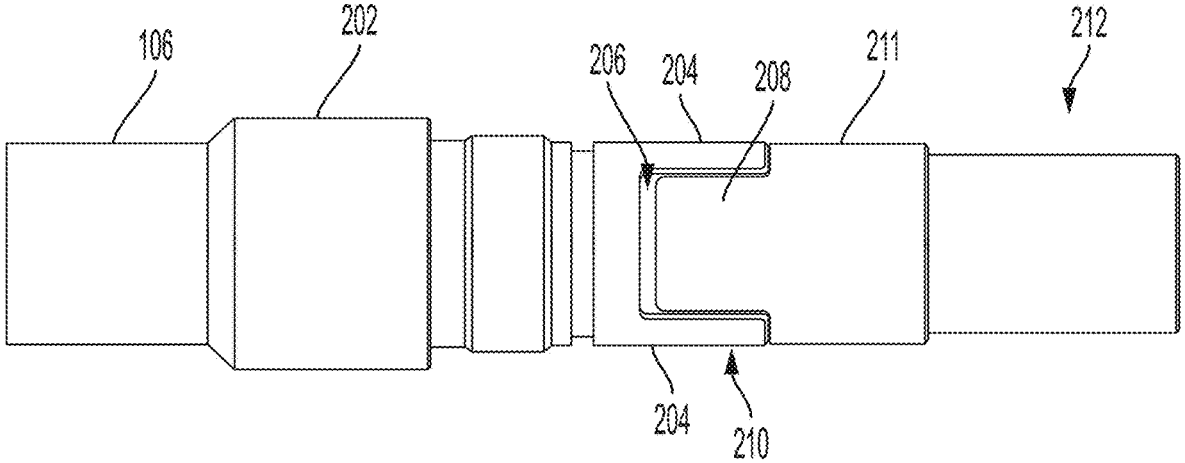
FIG. 5 is a side view of the top sub of FIG. 3 mated with the uphole portion of the inner-mandrel of FIG. 4 according to one embodiment of the present disclosure.

FIG. 5 is a side view of the top sub 202 mated with the uphole portion 211 of the inner-mandrel 212 according to one embodiment of the present disclosure. As illustrated, the lugs 204 of the top sub 202 are aligned for receipt into the slots 210 of the uphole portion 211, and the lugs 208 of the uphole portion 211 are aligned for receipt into the slots 206 of the top sub 202. In an example, torque generated from the rotation of the uphole tubular string 106 is transmitted to the inner-mandrel 212, and ultimately to the downhole tubular string 104, through the lugs and slots of the top sub 202 and the uphole portion 211 of the inner-mandrel 212.

Figure 6:
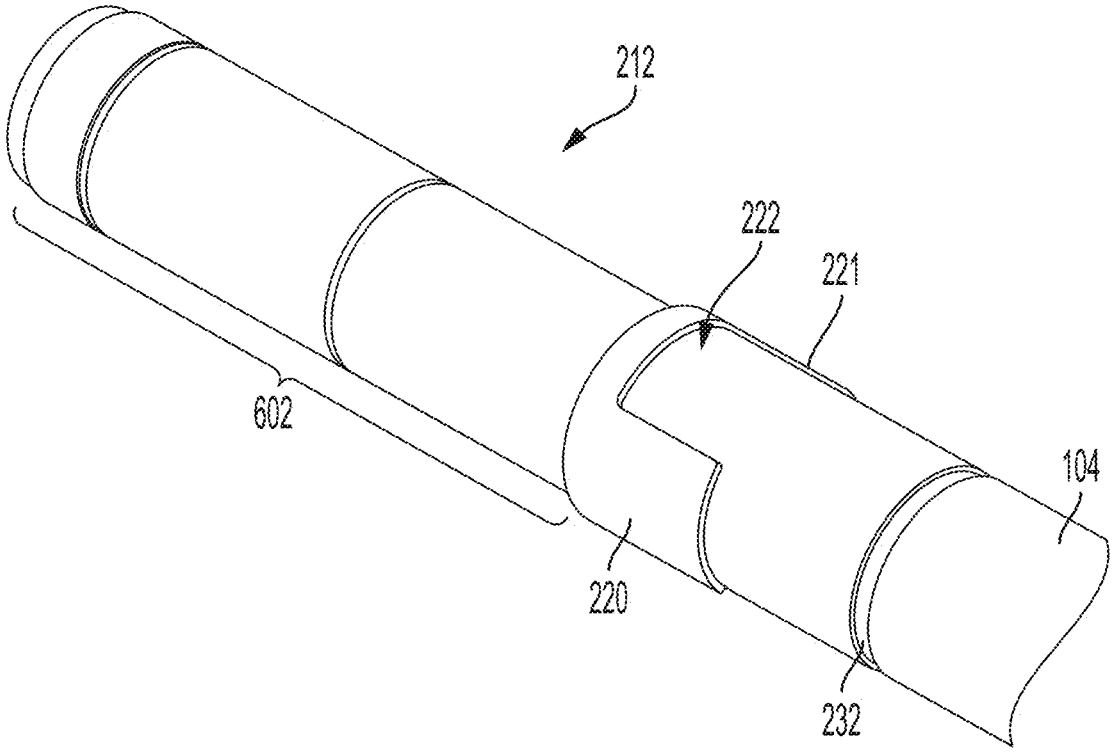
FIG. 6 is a perspective view of an inner-mandrel of the travel joint of FIG. 2 according to another embodiment of the present disclosure.

FIG. 6 is a perspective view of the inner-mandrel 212 of the travel joint 108 according to another embodiment of the present disclosure. In an example, the lugs 221 and the slots 222 of the inner-mandrel are integral to the downhole tubular string 104. In other words, the lugs 221 and the slots 222 are formed on the downhole tubular string 104 from the same material as the downhole tubular string 104. An area 602 of the inner-mandrel 212 may receive the seal stack 227 prior to installation of the inner-mandrel 212 within the outer-mandrel 214.

Also depicted is the groove 232, which may receive the shear pins 218 from the bottom sub 216. Additional grooves, such as the grooves 234 and 236 depicted in FIG. 2 may also be positioned along a length of the downhole tubular string 104. The varying positions of grooves 232, 234, and 236 along the downhole tubular string 104 may alter the positioning of the inner-mandrel 212 within the outer-mandrel 214 prior to activation of the travel joint 108. For example, the groove 232 may position the inner-mandrel 212 in the tension arrangement with the outer-mandrel 214, and the other grooves 234 and 236, as shown in FIG. 2, may place the inner-mandrel 212 in the free-rotation arrangement or the compression arrangement with the outer-mandrel 214, respectively.

Figure 7:
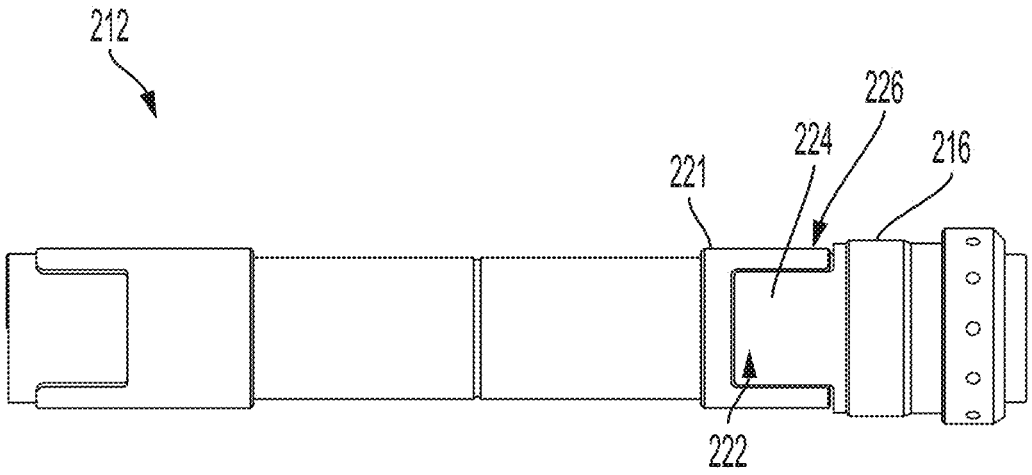
FIG. 7 is a side view of the inner-mandrel of FIG. 6 mated with a bottom sub of an outer-mandrel of the travel joint of FIG. 2 according to one embodiment of the present disclosure.

FIG. 7 is a side view of the inner-mandrel 212 mated with the bottom sub 216 of the outer-mandrel 214 of the travel joint 108 according to one embodiment of the present disclosure. As illustrated, the lugs 221 of the inner-mandrel 212 are aligned for receipt into the slots 226 of the bottom sub 216, and the lugs 224 of the bottom sub 216 are aligned for receipt into the slots 222 of the inner-mandrel 212. In an example, torque generated from the rotation of the uphole tubular string 106 is transmitted to the inner-mandrel 212, and ultimately to the downhole tubular string 104, through the lugs and slots of the bottom sub 216 and the inner-mandrel 212.

Figure 8:
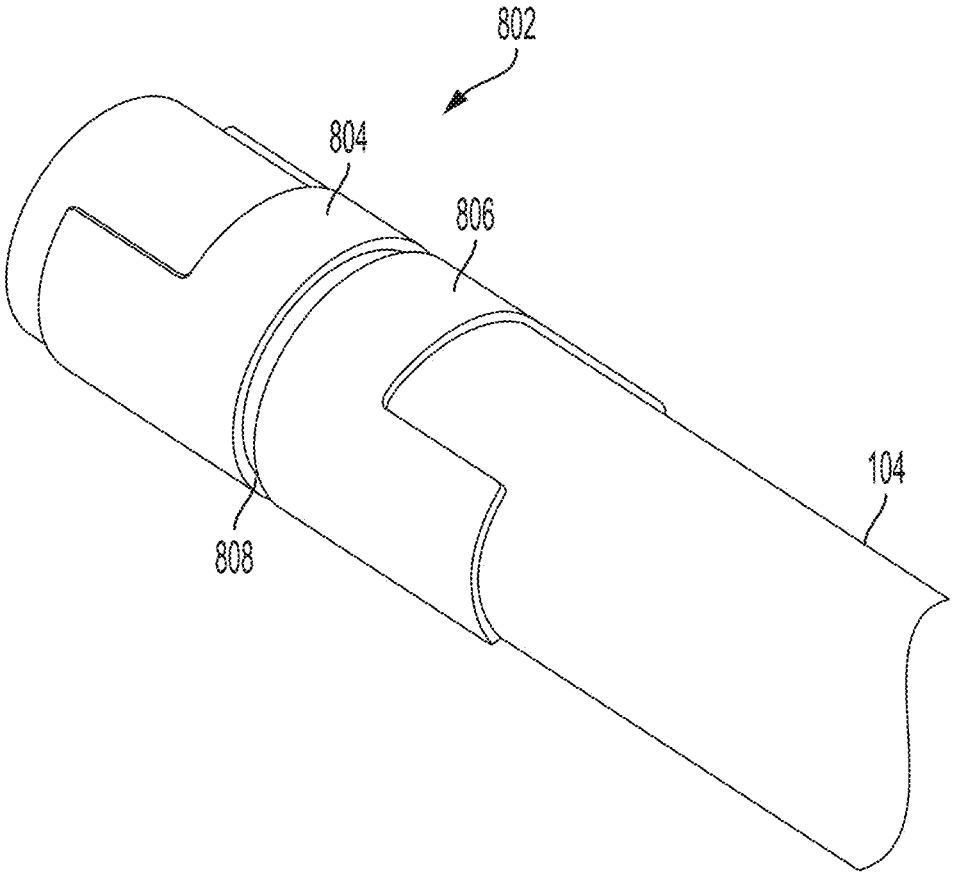
FIG. 8 is a perspective view of an inner-mandrel of the travel joint of FIG. 2 according to one embodiment of the present disclosure.

FIG. 8 is a perspective view of an inner-mandrel 802 of the travel joint 108 according to one embodiment of the present disclosure. The inner-mandrel 802 may be coupled to or be a part of the downhole tubular string 104. As illustrated, an upper portion 804 of the inner-mandrel 802 may replace the uphole portion 211 of the inner-mandrel 212 depicted in FIG. 2. Instead of being a separate component from the remainder of the inner-mandrel 802, the upper portion 804 may be part of a singular component that makes up the inner-mandrel 802. In other words, the upper portion 804 and a lower portion 806 may be made from a single piece of material. In some examples, the upper portion 804 and the lower portion 806 are integral with the downhole tubular string 104.

Further, a groove 808 may be positioned between the upper portion 804 and the lower portion 806. The groove 808 may receive a sealing device, such as an o-ring or a molded seal, to create the seal between the conduit 228 of the travel joint 108 and the annulus 110 between the travel joint 108 and the wall 111 of the wellbore 102. In replacing the seal stack 227 with a more compact seal in the groove 808, the overall length of the travel joint 108 may be shortened. A shortened system may be beneficial to enhance tubing maneuverability using the free-rotation and torque transmission provided by the travel joint 108.

Figure 9:
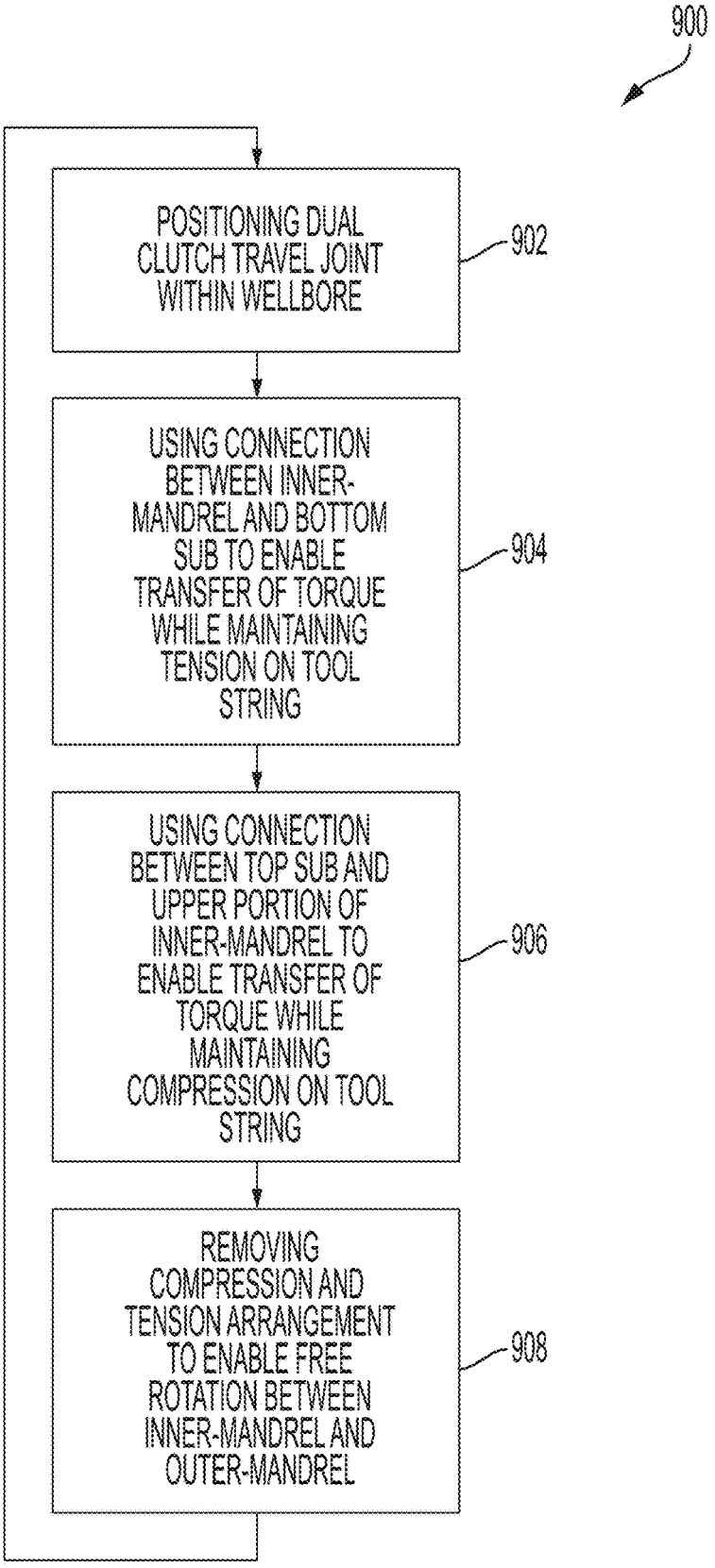
FIG. 9 is a flow chart of an example of a process for using the travel joint of FIG. 2 according to one embodiment of the present disclosure.

FIG. 9 is a flow chart of an example of a process 900 for using the travel joint 108 according to one embodiment of the present disclosure. At block 902, the process 900 involves positioning the travel joint 108 at a desired location within the wellbore 102. The travel joint 108 can include the dual clutch system described above with respect to FIGS. 1-8. In an example, the dual clutch system may refer to the travel joint 108 remaining operable in the tension arrangement and the compression arrangement, while also being operable in the free-rotation arrangement when the dual clutch system is disengaged.

At block 904, the process 900 involves using a connection between the inner-mandrel 212 and the bottom sub 216 of the outer-mandrel 214 to enable transfer of torque from the uphole tubular string 106 to the downhole tubular string 104. In an example, the connection between the inner-mandrel 212 and the bottom sub 216 may be established by mating the lugs 221 and slots 222 of the inner-mandrel 212 with the lugs 224 and slots 226 of the bottom sub 216. The connection between the inner-mandrel 212 and the bottom sub 216 may be established while the travel joint 108 is in an unactivated state, such as when being run into the wellbore 102, or the connection between the inner-mandrel 212 and the bottom sub 216 may be established when the travel joint 108 is in the tension arrangement.

In block 906, the process 900 involves using a connection between the top sub 202 and the uphole portion 211 of the inner-mandrel 212 to enable transfer of torque from the uphole tubular string 106 to the downhole tubular string 104. In an example, the connection between the top sub 202 and the uphole portion 211 may be established by mating the lugs 204 and slots 206 of the top sub 202 with the lugs 208 and slots 210 of the uphole portion 211. The connection between the top sub 202 and the uphole portion 211 may be established while the travel joint 108 is in an unactivated state, such as when being run into the wellbore 102, or the connection between the top sub 202 and the uphole portion 211 may be established when the travel joint 108 is in the compression arrangement.

In block 908, the process 900 involves removing the compression arrangement or the tension arrangement of the inner-mandrel 212 and the outer-mandrel 214 to enable free rotation of the inner-mandrel 212 and the outer-mandrel 214. The free-rotation arrangement of the inner-mandrel 212 and the outer-mandrel 214 may be established while the travel joint 108 is in an unactivated state, such as when being run into the wellbore 102, or the free-rotation arrangement may be established when the inner-mandrel 212 of the travel joint 108 is positioned without engaging the top sub 202 and the bottom sub 216.

In some embodiments, the travel joint 108 may be in an unactivated state in any of the tension arrangement, the compression arrangement, or the free-rotation arrangement. The unactivated state arrangement may depend on a location of the shear pins 218 along the downhole tubular string 104, as discussed above with respect to FIG. 2. Further, once the travel joint 108 is activated by shearing the shear pins 218, the travel joint 108 may transition between any of the tension arrangement, the compression arrangement, or the free-rotation arrangement by applying a force on the uphole tubular string 106 in the directions 220 and 230.

In some aspects, a dual clutch system for a travel joint is provided according to one or more of the following examples.

As used below, any reference to a series of examples is to be understood as a reference to each of those examples disjunctively (e.g., "Examples 1-4" is to be understood as "Examples 1, 2, 3, or 4").

Example 1 is a dual clutch travel joint system, comprising: an inner-mandrel comprising: a first connector on a downhole portion of the inner-mandrel; and a second connector on an uphole portion of the inner-mandrel; and an outer-mandrel comprising: a third connector positionable to mate with the first connector to apply torque to the inner-mandrel while the inner-mandrel is in a tension arrangement with the outer-mandrel within a wellbore; and a fourth connector positionable to mate with the second connector to apply torque to the inner-mandrel while the inner-mandrel is in a compression arrangement with the outer-mandrel within the wellbore.

Example 2 is the system of example 1, wherein the inner-mandrel and the outer-mandrel are positionable to free-rotate with respect to one another while the inner-mandrel and the outer-mandrel are between the tension arrangement and the compression arrangement with one another.

Example 3 is the system of examples 1-2, further comprising a seal or a seal stack positionable between the first connector and the second connector of the inner-mandrel to maintain a hydraulic seal between a conduit of the inner-mandrel and an annulus of the wellbore.

Example 4 is the system of examples 1-3, wherein the first connector is integral to a portion of completion tubing extendable downhole within the wellbore from the outer-mandrel.

Example 5 is the system of example 4, wherein the second connector is attachable at an uphole end of the portion of completion tubing comprising the first connector.

Example 6 is the system of examples 1-5, wherein the outer-mandrel further comprises: a shear sub comprising at least one shear pin, wherein the at least one shear pin is positionable to shear upon receiving a compressive force from the outer-mandrel to enable relative movement of the inner-mandrel from the tension arrangement to the compression arrangement or a free-rotation arrangement.

Example 7 is the system of examples 1-6, wherein the outer-mandrel further comprises: a shear sub comprising at least one shear pin, wherein the shear sub is couplable to the inner-mandrel to maintain the inner-mandrel and the outer-mandrel in the tension arrangement, the compression arrangement, or a free-rotation arrangement prior to shearing of the at least one shear pin.

Example 8 is the system of examples 1-7, wherein the first connector and the second connector comprise lugs and slots that are positionable to mate with corresponding lugs and slots of the third connector and the fourth connector.

Example 9 is the system of examples 1-8, wherein the first connector and the second connector comprise a single piece of material, and wherein the inner-mandrel further comprises: a seal positionable within a groove between the first connector and the second connector.

Example 10 is a method, comprising: positioning a dual clutch travel joint within a wellbore; applying tension on the dual clutch travel joint to form a first connection between an outer-mandrel of the dual clutch travel joint and an inner-mandrel of the dual clutch travel joint, the first connection enabling a first transfer of torque from the outer-mandrel to the inner-mandrel; and applying compression on the dual clutch travel joint to form a second connection between the outer-mandrel and the inner-mandrel, the second connection enabling a second transfer of torque from the outer-mandrel to the inner-mandrel.

Example 11 is the method of example 10, further comprising: removing tension and compression on the dual clutch travel joint to disengage the first connection and the second connection to enable free-rotation between the inner-mandrel and the outer-mandrel.

Example 12 is the method of example 11, further comprising: manipulating one or more wellbore tools uphole from the travel joint during the free-rotation between the inner-mandrel and the outer-mandrel while preventing application of torque on a downhole portion of completion string coupled to the travel joint.

Example 13 is the method of examples 10-12, wherein applying the compression on the dual clutch travel joint shears at least one shearing pin to enable relative movement between the outer-mandrel and the inner-mandrel from the first connection to the second connection.

Example 14 is the method of examples 10-13, wherein applying the tension on the dual clutch travel joint enables a first lug connector on a downhole portion of the inner-mandrel to engage with a corresponding first lug connector of the outer-mandrel on a downhole portion of the outer-mandrel.

Example 15 is the method of examples 10-14, wherein applying compression on the dual clutch travel joint enables a second lug connector on an uphole portion of the inner-mandrel to engage with a corresponding second lug connector of the outer-mandrel on an uphole portion of the outer-mandrel.

Example 16 is an inner-mandrel, comprising: a first connector on a downhole portion of the inner-mandrel, the first connector positionable to receive torque from an outer-mandrel when the inner-mandrel is in a tension arrangement with the outer-mandrel; and a second connector on an uphole portion of the inner-mandrel, the second connector positionable to receive torque from the outer-mandrel when the inner-mandrel is in a compression arrangement with the outer-mandrel.

Example 17 is the inner-mandrel of example 16, wherein the first connector and the second connector are positionable to rotate independently from the outer-mandrel when the first connector and the second connector are not engaged with the outer-mandrel.

Example 18 is the inner-mandrel of example 17, wherein the first connector comprises a first lug connector positionable to mate with a downhole sub of the outer-mandrel while the inner-mandrel is in the tension arrangement with the outer-mandrel, and wherein the second connector comprises a second lug connector positionable to mate with an uphole sub of the outer-mandrel while the inner-mandrel is in the compression arrangement with the outer-mandrel.

Example 19 is the inner-mandrel of examples 16-18, further comprising: at least one seal positionable between the first connector and the second connector to maintain a hydraulic seal between a conduit of the inner-mandrel and an annulus of a wellbore.

Example 20 is the inner-mandrel of examples 16-19, wherein the first connector and the second connector comprises a single piece of material.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A dual clutch travel joint system, comprising:

an inner-mandrel comprising:

a first connector on a downhole portion of the inner-mandrel, wherein the first connector comprises a first set of lugs and slots; and a second connector on an uphole portion of the inner-mandrel, wherein the second connector comprises a second set of lugs and slots; and an outer-mandrel comprising:

a third connector comprising a third set of lugs and slots positionable to mate with the first set of lugs and slots of the first connector to apply torque to the inner-mandrel while the inner-mandrel is in a tension arrangement with the outer-mandrel within a wellbore; and a fourth connector comprising a fourth set of lugs and slots positionable to mate with the second set of lugs and slots of the second connector to apply torque to the inner-mandrel while the inner-mandrel is in a compression arrangement with the outer-mandrel within the wellbore.

2. The system of claim 1, wherein the inner-mandrel and the outer-mandrel are positionable to free-rotate with respect to one another while the inner-mandrel and the outer-mandrel are between the tension arrangement and the compression arrangement with one another.

3. The system of claim 1, further comprising a seal or a seal stack positionable between the first connector and the second connector of the inner-mandrel to maintain a hydraulic seal between a conduit of the inner-mandrel and an annulus of the wellbore.

4. The system of claim 1, wherein the first connector is integral to a portion of completion tubing extendable downhole within the wellbore from the outer-mandrel.

5. The system of claim 4, wherein the second connector is attachable to an uphole end of the portion of completion tubing comprising the first connector.

6. The system of claim 1, wherein the outer-mandrel further comprises:

a shear sub comprising at least one shear pin, wherein the at least one shear pin is positionable to shear upon receiving a compressive force from the outer-mandrel to enable relative movement of the inner-mandrel from the tension arrangement to the compression arrangement or a free-rotation arrangement.

7. The system of claim 1, wherein the outer-mandrel further comprises:

a shear sub comprising at least one shear pin, wherein the shear sub is couplable to the inner-mandrel to maintain the inner-mandrel and the outer-mandrel in the tension arrangement, the compression arrangement, or a free-rotation arrangement prior to shearing of the at least one shear pin.

8. The system of claim 1, wherein the first connector and the second connector comprise a single piece of material, and wherein the inner-mandrel further comprises:

a seal positionable within a groove between the first connector and the second connector.

9. A method, comprising:

positioning a dual clutch travel joint within a wellbore;

applying tension on the dual clutch travel joint to form a first connection between a first set of lugs and slots on a downhole portion of an outer-mandrel of the dual clutch travel joint and a corresponding first set of lugs and slots on a downhole portion of an inner-mandrel of the dual clutch travel joint, the first connection enabling a first transfer of torque from the outer-mandrel to the inner-mandrel; and applying compression on the dual clutch travel joint to form a second connection between a second set of lugs and slots on an uphole portion of the outer-mandrel and a corresponding second set of lugs and slots on an uphole portion of the inner-mandrel, the second connection enabling a second transfer of torque from the outer-mandrel to the inner-mandrel.

10. The method of claim 9, further comprising:

removing tension and compression on the dual clutch travel joint to disengage the first connection and the second connection to enable free-rotation between the inner-mandrel and the outer-mandrel.

11. The method of claim 10, further comprising:

manipulating one or more wellbore tools uphole from the travel joint during the free-rotation between the inner-mandrel and the outer-mandrel while preventing application of torque on a downhole portion of completion string coupled to the travel joint.

12. The method of claim 9, wherein applying the compression on the dual clutch travel joint shears at least one shearing pin to enable relative movement between the outer-mandrel and the inner-mandrel from the first connection to the second connection.

13. An inner-mandrel, comprising:

a first connector on a downhole portion of the inner-mandrel, the first connector positionable to receive torque from an outer-mandrel when the inner-mandrel is in a tension arrangement with the outer-mandrel, wherein the first connector comprises a first lug connector positionable to mate with a downhole sub of the outer-mandrel while the inner-mandrel is in the tension arrangement with the outer-mandrel; and a second connector on an uphole portion of the inner-mandrel, the second connector positionable to receive torque from the outer-mandrel when the inner-mandrel is in a compression arrangement with the outer-mandrel, and wherein the second connector comprises a second lug connector positionable to mate with an uphole sub of the outer-mandrel while the inner-mandrel is in the compression arrangement with the outer-mandrel.

14. The inner-mandrel of claim 13, wherein the first connector and the second connector are positionable to rotate independently from the outer-mandrel when the first connector and the second connector are not engaged with the outer-mandrel.

15. The inner-mandrel of claim 13, further comprising:

at least one seal positionable between the first connector and the second connector to maintain a hydraulic seal between a conduit of the inner-mandrel and an annulus of a wellbore.

16. The inner-mandrel of claim 13, wherein the first connector and the second connector together comprise a single piece of material.

* * * * *